United States Patent [19]

McIntire et al.

[11] 4,099,511

[45] Jul. 11, 1978

[54] REMOVABLE FUEL DOOR ON A WOOD BURNING STOVE

[76] Inventors: Kendrick H. McIntire, Rte. 2 Box 1000; John E. McIntire, Rte. 2 Box 151-A, both of Aurora, Oreg. 97002

[21] Appl. No.: 763,299

[22] Filed: Jan. 28, 1977

Related U.S. Application Data

[63] Continuation of Ser. No. 642,985, Dec. 22, 1975, abandoned.

[51] Int. Cl.[2] ..... F23M 7/00

[52] U.S. Cl. ..... 126/190; 126/194; 49/261; 49/397; 49/465

[58] Field of Search ..... 126/190, 198, 194, 192, 126/191, 193, 200; 110/173 R; 49/463, 465, 261, 397

[56] References Cited

U.S. PATENT DOCUMENTS

| | | | |
|---|---|---|---|
| 59,119 | 10/1866 | Batchelor | 126/194 |
| 1,222,894 | 4/1917 | Scruggs | 126/194 |
| 2,547,117 | 4/1951 | Hardwick | 126/200 |
| 2,823,663 | 2/1958 | Aten et al. | 126/194 |
| 3,736,916 | 6/1973 | White | 126/198 |
| 3,889,654 | 6/1975 | Kauranen | 126/194 |

FOREIGN PATENT DOCUMENTS

| | | | |
|---|---|---|---|
| 225,570 | 6/1962 | Austria | 49/261 |

*Primary Examiner*—John J. Camby
*Assistant Examiner*—Larry I. Schwartz
*Attorney, Agent, or Firm*—Klarquist, Sparkman, Campbell, Leigh, Hall & Whinston

[57] ABSTRACT

A wood burning stove has a fire chamber with an opening surrounded by a jamb, and a door having a pair of hooklike hinge rods is hinged to a hearth plate and is removable. The door has a gasket and, when, closed, the latches clamp the gasket against the jamb.

5 Claims, 7 Drawing Figures

REMOVABLE FUEL DOOR ON A WOOD BURNING STOVE

This is a continuation of application Ser. No. 642,985 filed Dec. 12, 1975 now abandoned.

DESCRIPTION

This invention relates to an improved wood burning heating stove, and has for an object thereof the provision of a new and improved wood burning heating stove.

The principle object of the present invention is to permit the user of the stove to use the fuel door as a tight fitting fuel door on a wood burning stove but when desired the user may instantly remove the fuel door thus converting the otherwise air tight stove to an open front, open burning fireplace.

Other objects of the invention will appear in the following summary:

In the drawing which accompanies and forms a part of the following specifications and throughout the figures of which the same reference numbers have been used to denote identical parts:

Figure 1:
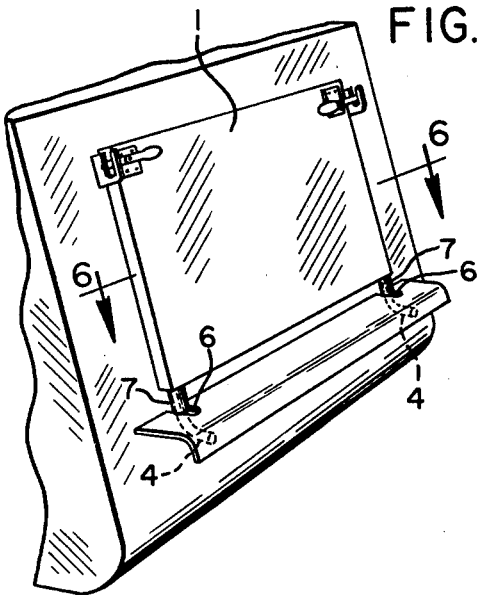
FIG. 1 is a fragmentary perspective view of a stove forming one embodiment of the invention.

Refering now in detail to the several figures, the numeral 1 represents the door formed of sheet metal. The door is formed in double construction with an inside panel 2 electrically welded to the outside panel.

Two rods 3 are welded in the inner channel and extend through two holes at the bottom of the door eventually being bent or curved toward the front of the door. The bent or curved ends of the rods 4 describe an arc precisely determined to hold the door in an open position 5 by reason of their bent or curved ends resting against the front of the stove and the slot in the support flange 6 holding the rod at its upper part just below the spacer tubes 7 from falling forward. A small spacer tube 7 slips over the hinge rods and rest against the bottom of the door thus positioning the door in the correct position relative to the door jamb 9.

Figure 7:
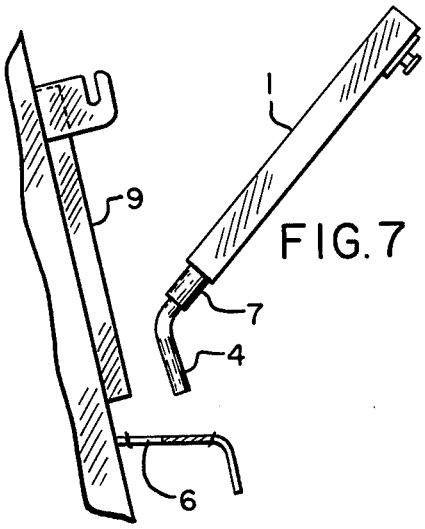
FIG. 7 is an enlarged, fragmentary, side elevation view of the stove of FIG. 1.
Figure 6:
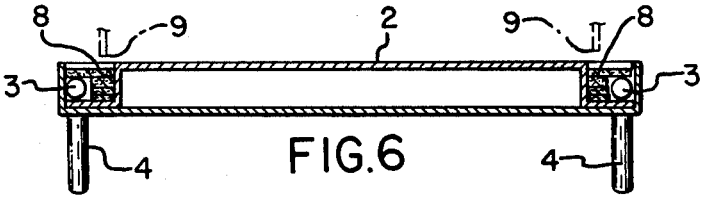
FIG. 6 is an enlarged, horizontal sectional view taken along line A—A of FIG. 1.

The door may be removed by lifting the door up while the door is in the open position as in FIG. 7. The slots in the flange 6 allows the curved rods to pass through. The door is replaced in the exact reverse fashion.

Figure 2:
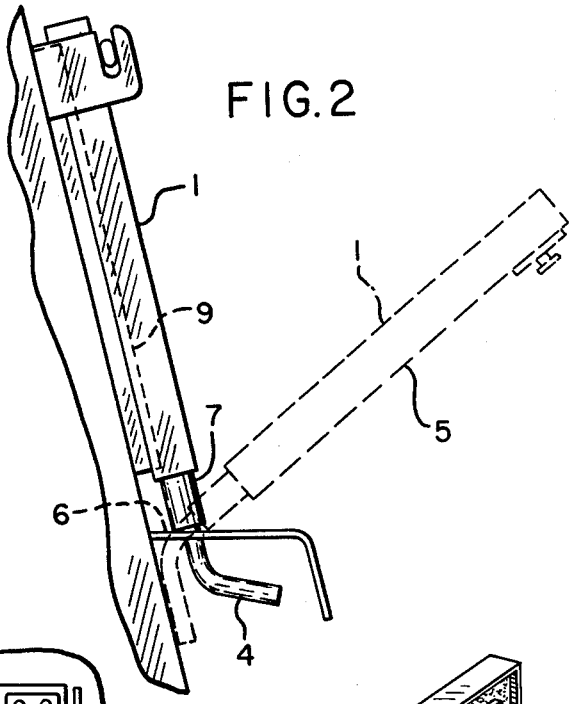
FIG. 2 is an enlarged, fragmentary, side elevation view of the stove of FIG. 1.
Figure 3:
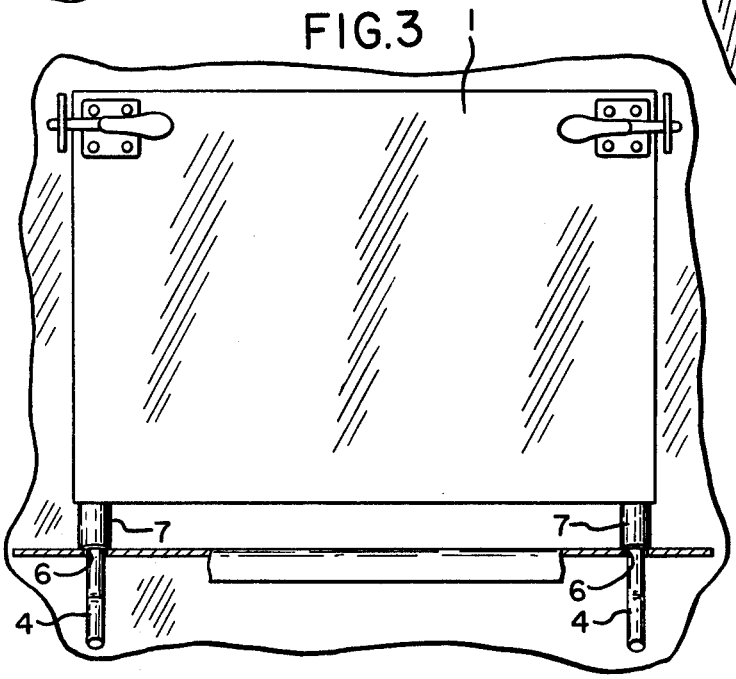
FIG. 3 is an enlarged, fragmentary, front elevation view of a door of the stove shown in FIG. 1.
Figure 5:
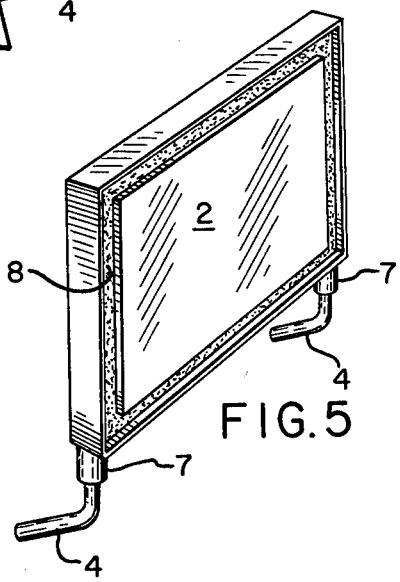
FIG. 5 is a perspective view of the inside or back side of the fuel door.
Figure 4:
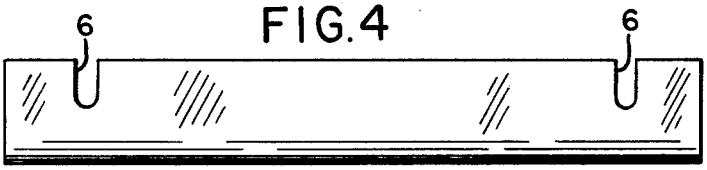
FIG. 4 is an enlarged, plan view of a support flange of the stove of FIG. 1.

The door is air tight while in the closed position as in FIGS. 1, 2, and 3 by virtue of a high temperature gasket material pressed into the open slots around the inside perimeter of the door 8. This gasket forms a tight seal against the door jamb 9 when in the closed position.

While I have in the above description disclosed what I believe to be a practical embodiment of the invention it will be understood by those skilled in the art that the specific details of the construction and arrangement of parts are by way of example and not to be construed as limiting the scope of the invention.

What I claim is:

1. In a wood burning heating stove, fire chamber means having a doorway surrounded by a jamb, a door, a hearth-like bracket secured to the fire chamber means in a position below the doorway and extending generally horizontally out from the doorway and having a pair of hinging slots, a pair of hook-like hinge members fixed to the lower edge of the door and insertable into the removable from the slots to hinge the lower edge of the door to the bracket, gasket means carried by the door, and means for latching the door in a closed position in which the gasket means seals the door to the jamb, the hook-like hinge members having end portions adapted to engage the fire chamber means when the door is in a substantially horizontal open position to hold the door in said open position.

2. The stove of claim 1 wherein the door has an endless groove and the gasket means is mounted in the groove.

3. The stove of claim 2 including a generally rectangular plate-like jamb an edge of which is adapted to be engaged by the gasket means when the door is in a closed position.

4. In a stove, fire chamber means having a generally vertical front wall provided with a doorway, a generally horizontal bracket mounted on the front wall below the bottom of the doorway and having slots therein, the bracket extending beyond the front wall and forming a hearth, and a door adapted to close the doorway and having parallel hook-like members adapted to project into the slots and removably hinge the door to the fire chamber means.

5. The stove of claim 4 wherein the hook-like members include a pair of rods and spacer tubes on the rods adapted to rest on the bracket.

* * * * *

UNITED STATES PATENT AND TRADEMARK OFFICE

CERTIFICATE OF CORRECTION

PATENT NO. : 4,099,511

DATED : July 11, 1978

INVENTOR(S) : Kendrick H. & John E. McIntire

It is certified that error appears in the above-identified patent and that said Letters Patent are hereby corrected as shown below:

Col. 1, line 4, change "Dec. 12" to -- Dec. 22--

Col. 2, line 24, (Claim 1) change "the" second occurrence to --and--

Signed and Sealed this

*Second* Day of *January 1979*

[SEAL]

*Attest:*

RUTH C. MASON
*Attesting Officer*

DONALD W. BANNER
*Commissioner of Patents and Trademarks*